United States Patent [19]

Oie et al.

[11] Patent Number: 4,541,847

[45] Date of Patent: Sep. 17, 1985

[54] AIR-PURIFYING APPARATUS

[75] Inventors: Naoyuki Oie; Hiromichi Koyama, both of Kasai; Takafumi Takegawa, Himeji, all of Japan

[73] Assignee: Sanyo Electric Co., Ltd., Japan

[21] Appl. No.: 634,794

[22] Filed: Jul. 26, 1984

[30] Foreign Application Priority Data

Jul. 26, 1983 [JP] Japan ..... 58-137297

[51] Int. Cl.[4] ..... B03C 3/12; B03C 3/40; B03C 3/82

[52] U.S. Cl. ..... 55/124; 55/131; 55/138; 55/152; 55/155; 55/279; 55/316; 55/467; 55/480; 55/507

[58] Field of Search ..... 55/124, 131, 138, 279, 55/316, 155, 152, 480, 467, 507

[56] References Cited

U.S. PATENT DOCUMENTS

| | | | |
|---|---|---|---|
| 2,873,908 | 2/1959 | Powers | 55/124 X |
| 3,105,750 | 10/1963 | Kayko et al. | 55/131 X |
| 3,108,865 | 10/1963 | Berly | 55/131 |
| 3,191,362 | 6/1965 | Bourgeois | 55/138 X |
| 3,745,750 | 7/1973 | Arff | 55/124 X |
| 4,244,712 | 1/1981 | Tongret | 55/124 |

*Primary Examiner*—Kathleen J. Prunner
*Attorney, Agent, or Firm*—Darby & Darby

[57] ABSTRACT

An air-purifying apparatus comprising: a main body having an intake portion and an outlet portion; a blower disposed in the main body and adapted to induce the ambient air through the intake portion and to forward the air to the outlet portion; and a high-voltage generating means mounted in the main body; wherein the intake portion includes a intake grille, first and second net-shaped electrode plates disposed along the inner side of the intake grille and opposing each other with a large potential difference developed therebetween by the high-voltage generating means, the first net-shaped electrode plate being remoter from the intake grille than the second net-shaped electrode plate, and an air-permeable filter made of a dielectric material disposed between the first and second electrode plates, and wherein at least the intake grille and the second net-shaped electrode plate being detachable from the main body.

11 Claims, 38 Drawing Figures

THE DISTANCE D1 OF MOVEMENT OF THE NEEDLE-LIKE IONIZATION ELECTRODE

THE DISTANCE D2 BETWEEN THE NEEDLE-LIKE IONIZATION ELECTRODE AND THE REGULATING MEMBER

AIR-PURIFYING APPARATUS

BACKGROUND OF THE INVENTION (a) Field of the Invention

The present invention relates to an air-purifying apparatus for collecting dust particles and the like floating in the air, and particularly to an air-purifying apparatus of the electrostatic fiber-layer dust filter type, wherein a fiber-layer filter formed by a dielectric material is clamped between electrode plates with high voltage applied thereto, dielectric polarization is thereby generated in the fiber-layer filter so as to absorb dust particles.

(b) Description of the Prior Art

Various techiques have been devised as techniques for collecting dust particles floating in the air. For instance, there is a method whereby dust particles is collected by catching the dust particles by filter means such as a net, fibers, and activated charcoal used for ventilating and air-conditioning equipment (refer to U.S. Pat. Nos. 3,828,530, 3,902,877, 4,272,261, etc.); However, it has not been possible to collect such fine particles as smoke. As a method for improving this point, a method was devised whereby dust particles are absorbed forcibly. As one example, there is a method of collecting dust particles electrostatically, which is widely adopted as an air cleaner for vehicles in recent years (for instance, refer to U.S. Pat. No. 3,108,865). This is a method whereby dust particles contained in the sucked air is charged with electricity by means of a corona discharge, and then the electrified dust particles are collected by a porous metal filter. According to this method, a conductor has been used as a filter, and a foamed metal has been used since it is necessary to make the filter thick. However, although dust particles adhered to the inner fine pores of the foamed metal can be removed to some extent by cleaning, it is not possible to clean them completely. Furthermore, although the life of the filter is long, the filter has been inconvenient to use. In addition, there is an air-purifying apparatus using electret fiber-layer filter. This air-purifying apparatus does not require a high-voltage device since the filter maintains electric polarization, but it is not possible to reuse it by cleaning it.

As a method of collecting dust for obviating the drawbacks of the aforementioned dust collecting methods, there is a method using an electrostatic fiber-layer dust-collecting filter, disclosed in the Japanese utility Model Publication No. 26039/1972 and the Japanese Patent Publication No. 41709/1976. In this method, a fiber-layer filter formed by a dielectric material is clamped between electrode plates with a high voltage applied thereto to generate dielectric polarization in the fiber-layer filter, thereby absorbing dust particles. This method has advantages in that the filter can be washed by a washing machine or the like and can be used repeatedly, and, at the same time, a reduction in the dust-collecting performance is small since a high voltage is applied even if dust particles are adhered to it.

In an air-purifying apparatus using the electrostatic fiber-layer dust-collecting filter system, the construction is such that a filter is provided midway in the air channel, so that it is necessary to provide a door for removing the filter, and it has been necessary to disassemble the air-purifying apparatus when conducting maintainance and inspection. This has also been true with the case of the U.S. Pat. No. 4,272,261, which was earlier cited as an example using a filter consisting of a net, fibers, etc.

In the case of the U.S. Pat. No. 3,828,530, however, the main filter is provided not midway in the air channel but along the outlet port. However, the filter is secured to the body, with the result that it has not been possible to easily effect the removal of the body and hence its maintenance and inspection.

SUMMARY OF THE INVENTION

The present invention is an air-purifying apparatus comprising: a main body having an intake portion and an outlet portion; a blowing means disposed in the main body and adapted to induce the ambient air through the intake portion and to forward the air to the outlet portion; and a high-voltage generating means mounted in the main body; wherein the intake portion includes an intake grille, first and second net-shaped electrode plates disposed along the inner side of the intake grille and opposing each other with a large potential difference developed therebetween by the high-voltage generating means, the first net-shaped electrode plate being remoter from the intake grille than the second net-shaped electrode plate, and an air-permeable filter made of a dielectric material disposed between the first and second electrode plates, and wherein at least the intake grille and the second net-shaped electrode plate being detachable from the main body.

In brief, since the electric dust-collecting plate (device) is mounted in a particular shape and detachably on the body together with the intake grille, the present invention facilitates the removal and installation of the filter disposed on the electric dust-collecting device, and, at the same time, facilitates the maintenance and inspection of the inside of the body of the air-purifying apparatus.

Furthermore, it is possible to provide an ion generating means inside the body, and it is thereby possible to expect a rise in the dust-collecting efficiency.

The air-purifying apparatus relating to the invention can be constructed with a very small size thanks to the characteristics of the aforementioned arrangement, and is suitable for use as an air-purifying apparatus for automobiles.

These and other advantages and objects of the air-purifying apparatus will be apparent from the accompanying description taken in conjunction with the attached drawings.

DETAILED DESCRIPTION OF THE DRAWINGS

FIGS. 1 to 27, inclusive, show a first embodiment of the invention, in which FIG. 1 is a front perspective view;

FIGS. 28 to 34, inclusive, show a second embodiment of the invention, in which

Figure 28:
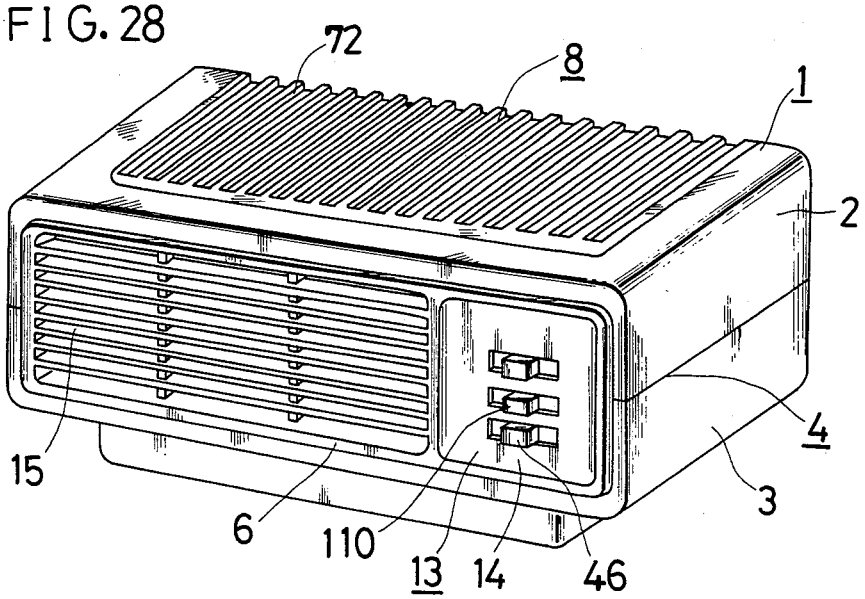
Figure 29:
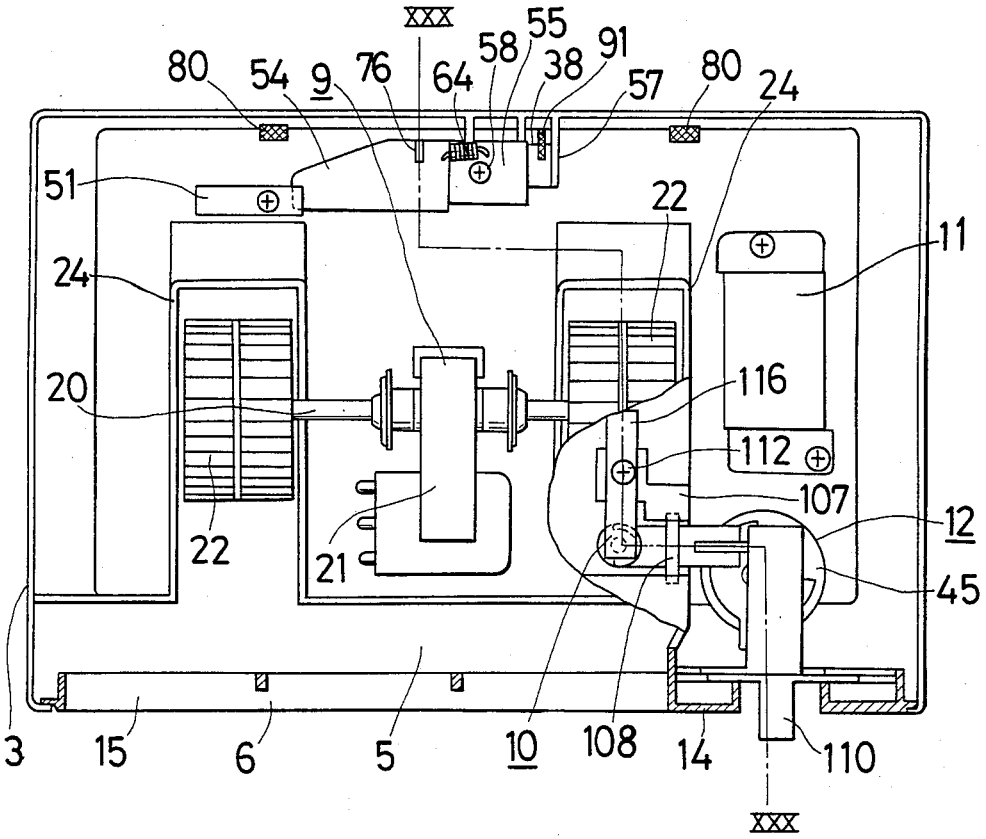
Figure 30:
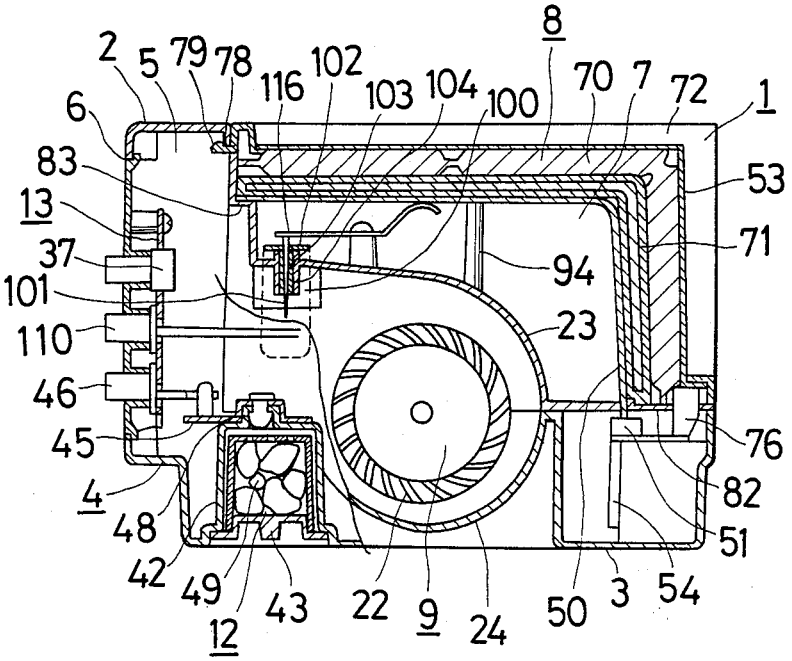
Figure 31:
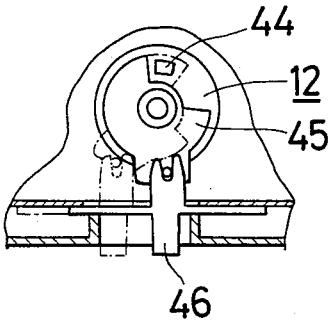
Figure 32:
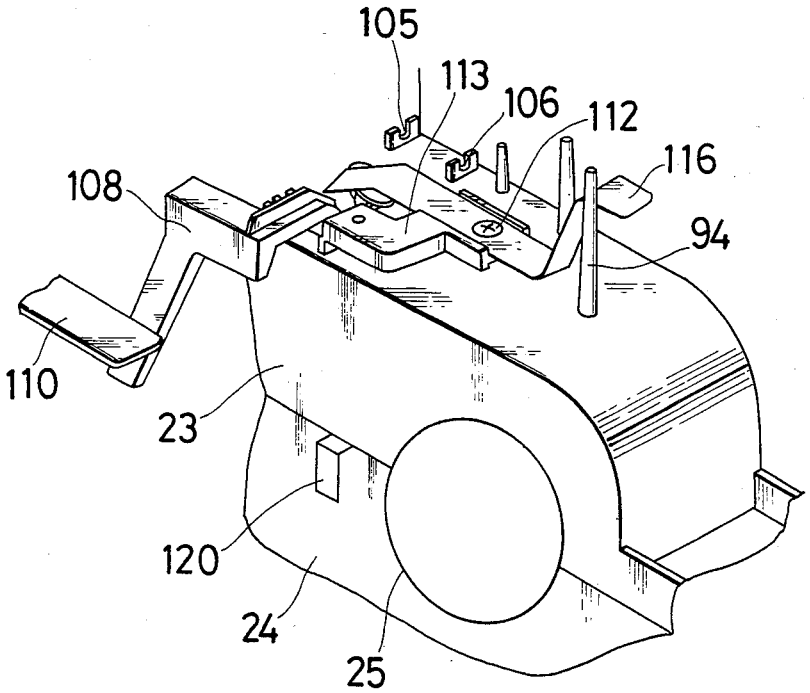

FIG. 28 is a perspective view;

FIG. 29 is a plan view of the lower case, partly in section;

FIG. 30 is a cross-sectional view taken along the line XXX—XXX of FIG. 29;

FIG. 31 is a plan view of a fragrance-discharging device;

FIG. 32 is a perspective view of the ion generating device; and

Figure 33:
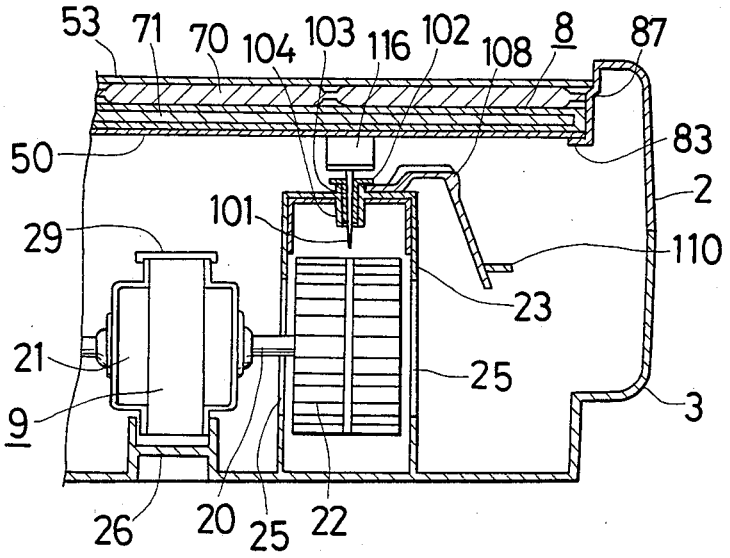
Figure 34:
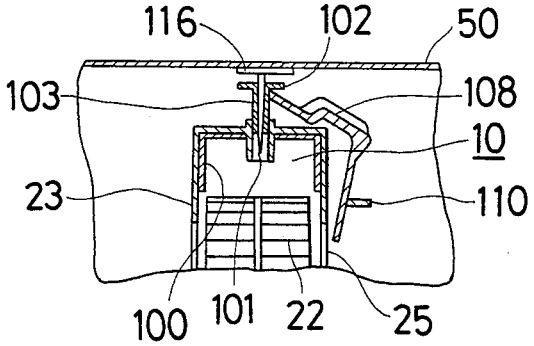

FIGS. 33 and 34 are cross-sectional views illustrating the operating condition of the ion generating device.

FIGS. 35 to 38, inclusive, show a third embodiment of the invention.

Figure 35:
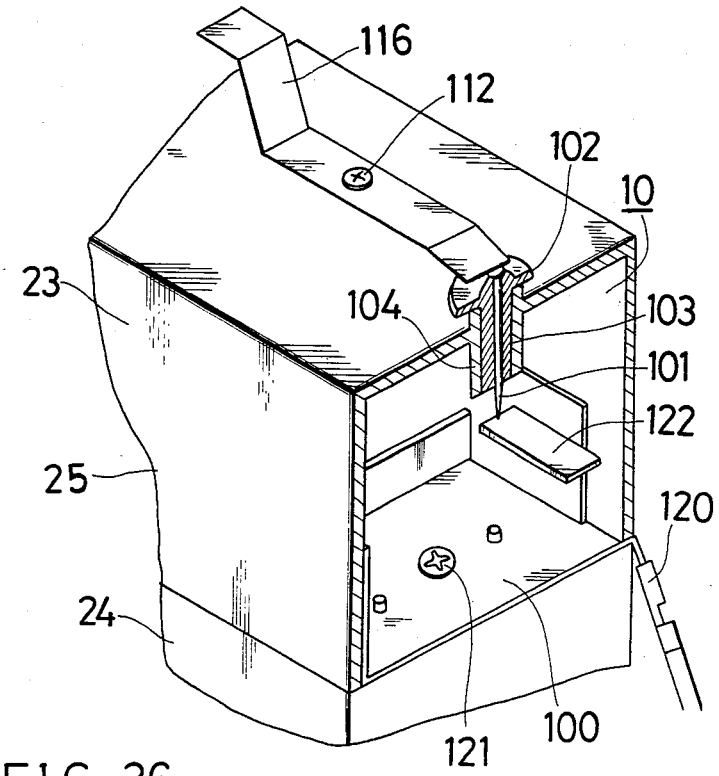
Figure 36:
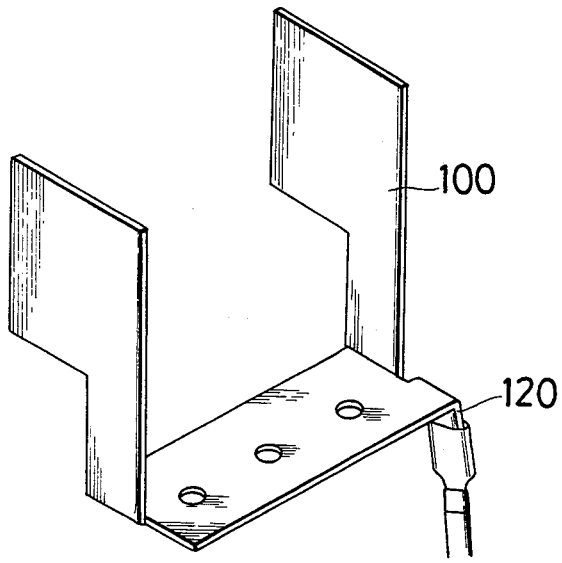
Figure 37:
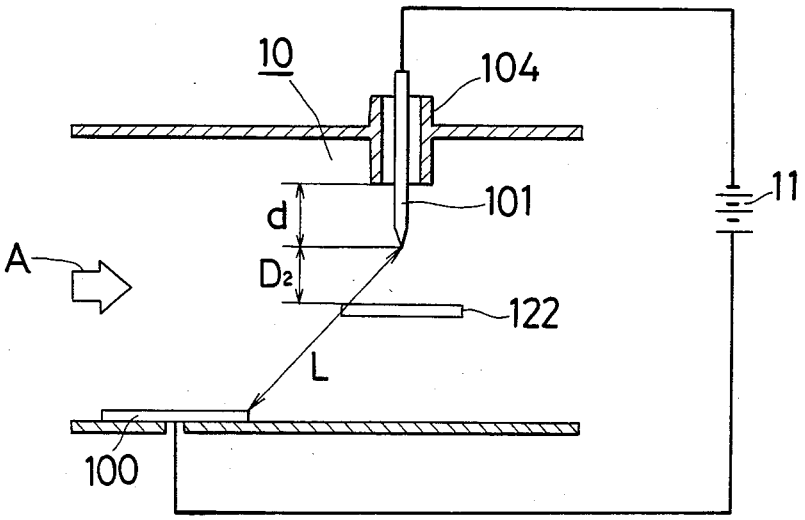
Figure 38:
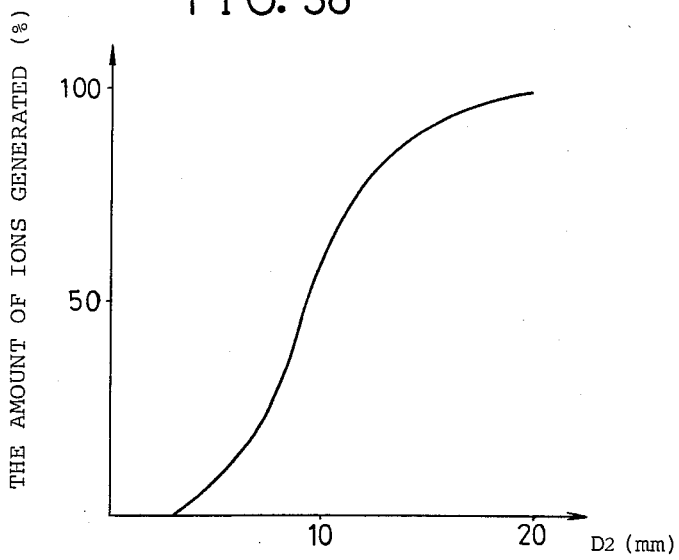

FIG. 35 is a sectional perspective view of the ion-generating device;

FIG. 36 is a perspective view of the ionization opposing electrode;

FIG. 37 is an explanatory diagram illustrating the basic principles of the ion generating device; and FIG. 38 is a chart on the characteristics of the ion generating device shown in FIG. 37.

DESCRIPTION OF THE PREFERRED EMBODIMENTS

Now, description will be made of a first embodiment of the invention with reference to FIGS. 1 to 27.

Figure 11:
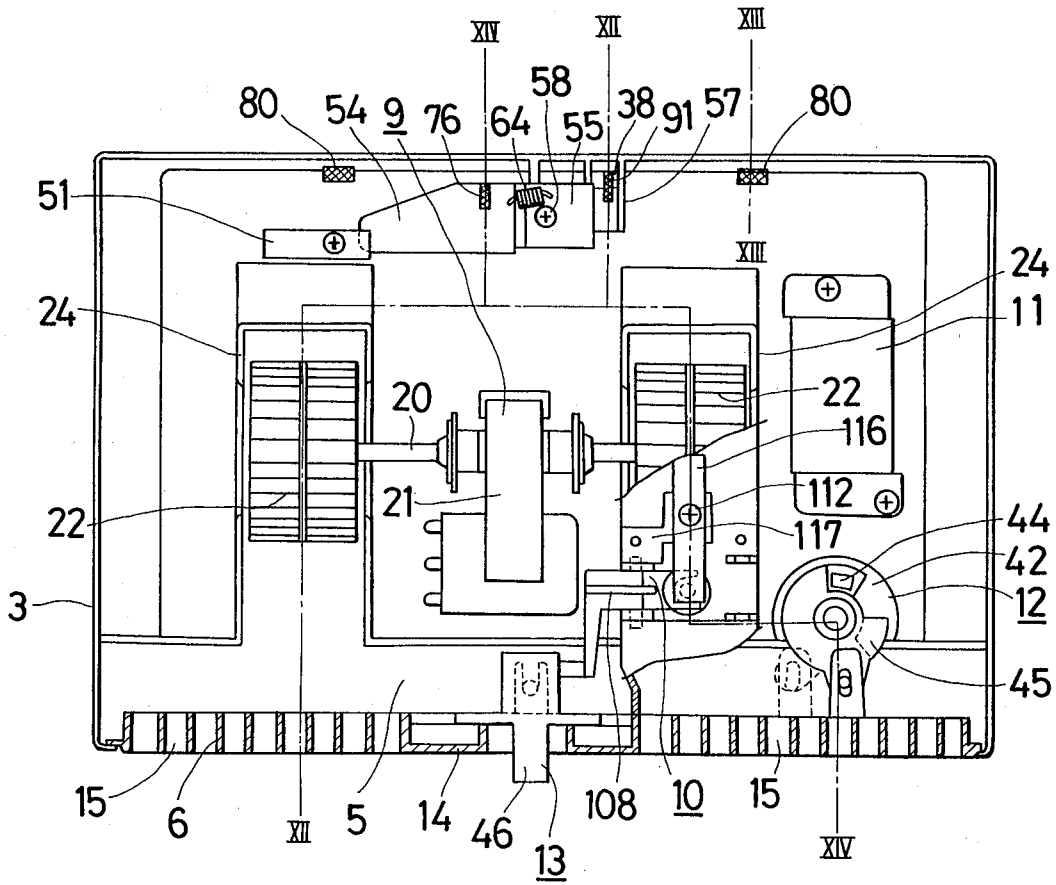
FIG. 11 is a plan view of a lower case, partly in section.
Figure 12:
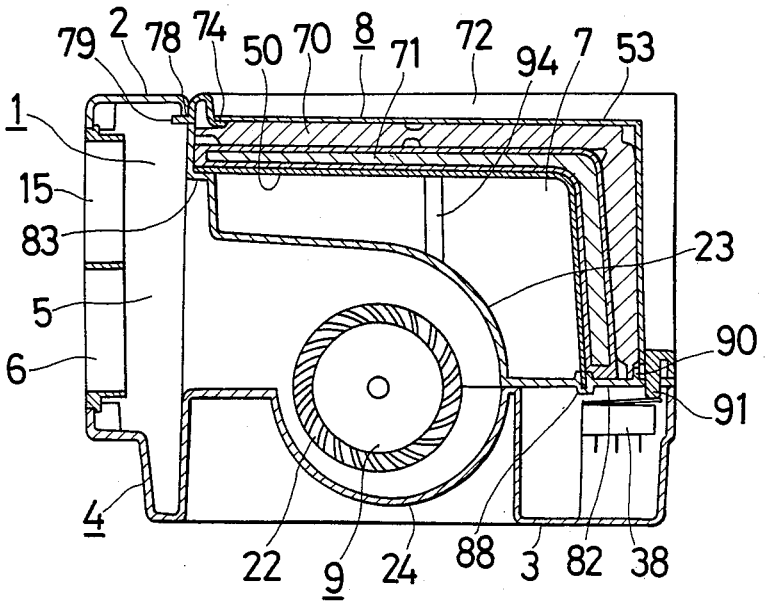
FIG. 12 is a cross-sectional view taken along the line XII—XII of FIG. 11.
Figure 13:
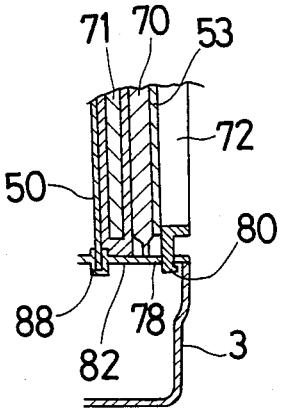
FIG. 13 is a cross-sectional view taken along the line XIII—XIII of FIG. 11.

Referring to FIGS. 11 to 12, which give details in particular, an air-purifying apparatus 1 includes the following: a body 4 having an upper case 2 and a lower case 3 formed into upper and lower sections; an air outlet grille 6 installed at an outlet port 5 formed on the front surface of the body 4; an electric dust-collecting device 8 installed at an intake port 7 formed in the area extending from the upper surface to the rear surface of the body 4; a blower 9 formed inside the body 4; an ion generating device 10 formed in an outlet ventilating channel of the blower 9; a high-voltage generating device 11 supplying a high voltage to the electric dust-collecting device 8 and ion-generating device 10; a fragrance-discharging device 12 formed in the body 4; and a controlling part 13 for controlling the blower 9, the high-voltage generating device 11, the ion-generating device 10, and the fragrance-discharging device 12.

The upper case 2, the lower case 3, and the air outlet grille 6 are formed by synthetic resin of an insulating material. The air outlet gri11 6 comprises an installing part 14 for the controlling part 13 in its central portion, and grate-shaped ventilation parts 15, 15 on its both sides. The air outlet grille 6 is retained by a supporting part formed in the upper case 2 and the lower case 3, and, at the same time, is clamped between the upper case 2 and the lower case 3. The upper case 2 and the lower case 3 are connected by a screw (not shown) screwed in from the lower case 3 to the upper case 2.

Figure 1:
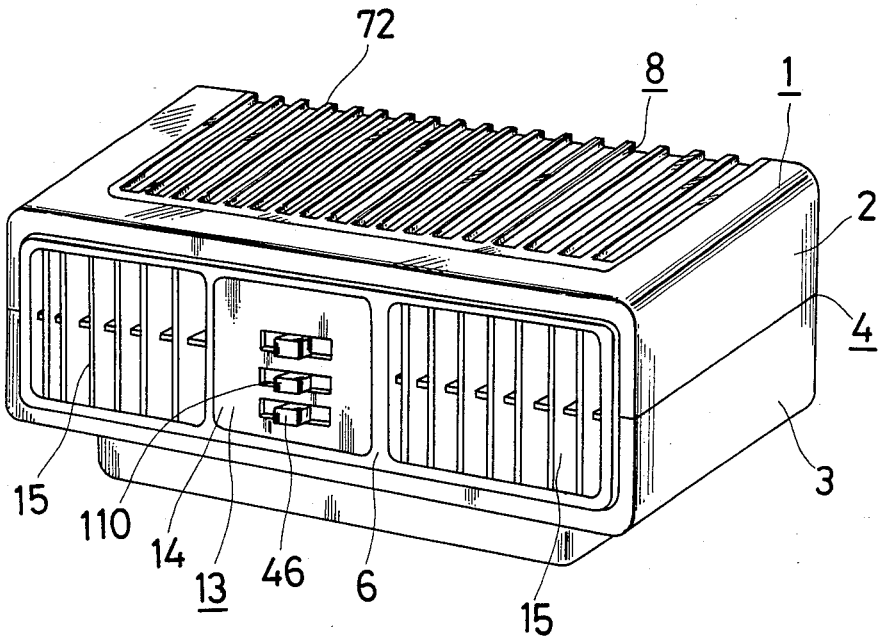
Figure 2:
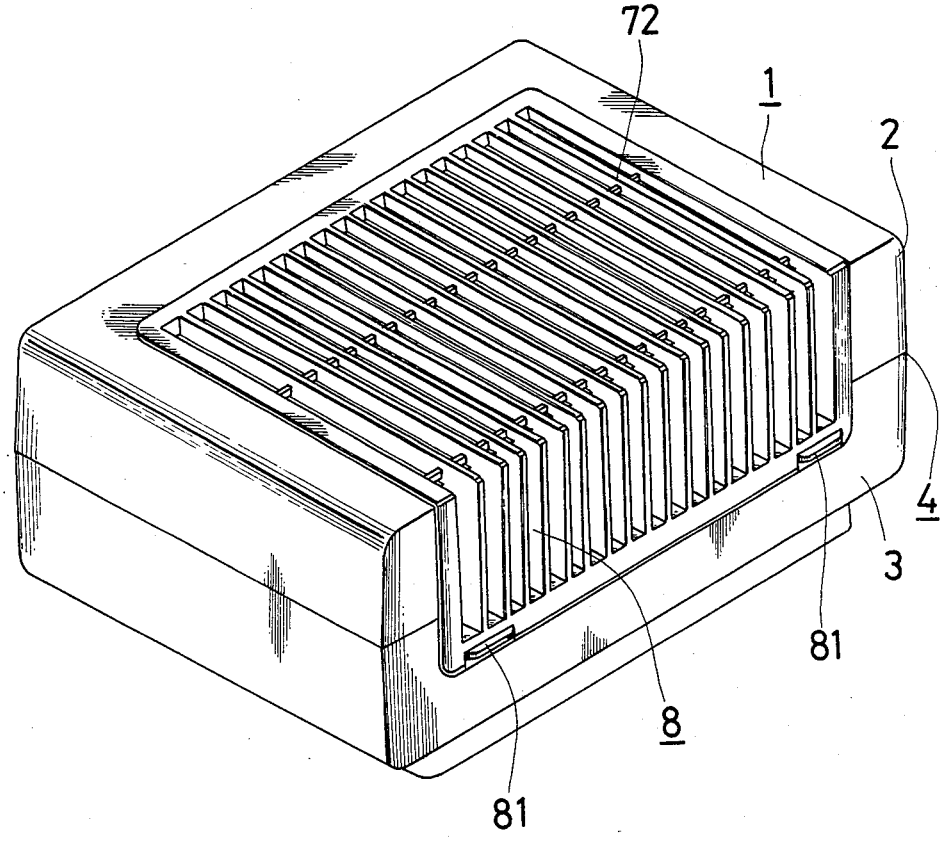
FIG. 2 is a rear perspective view.
Figure 3:
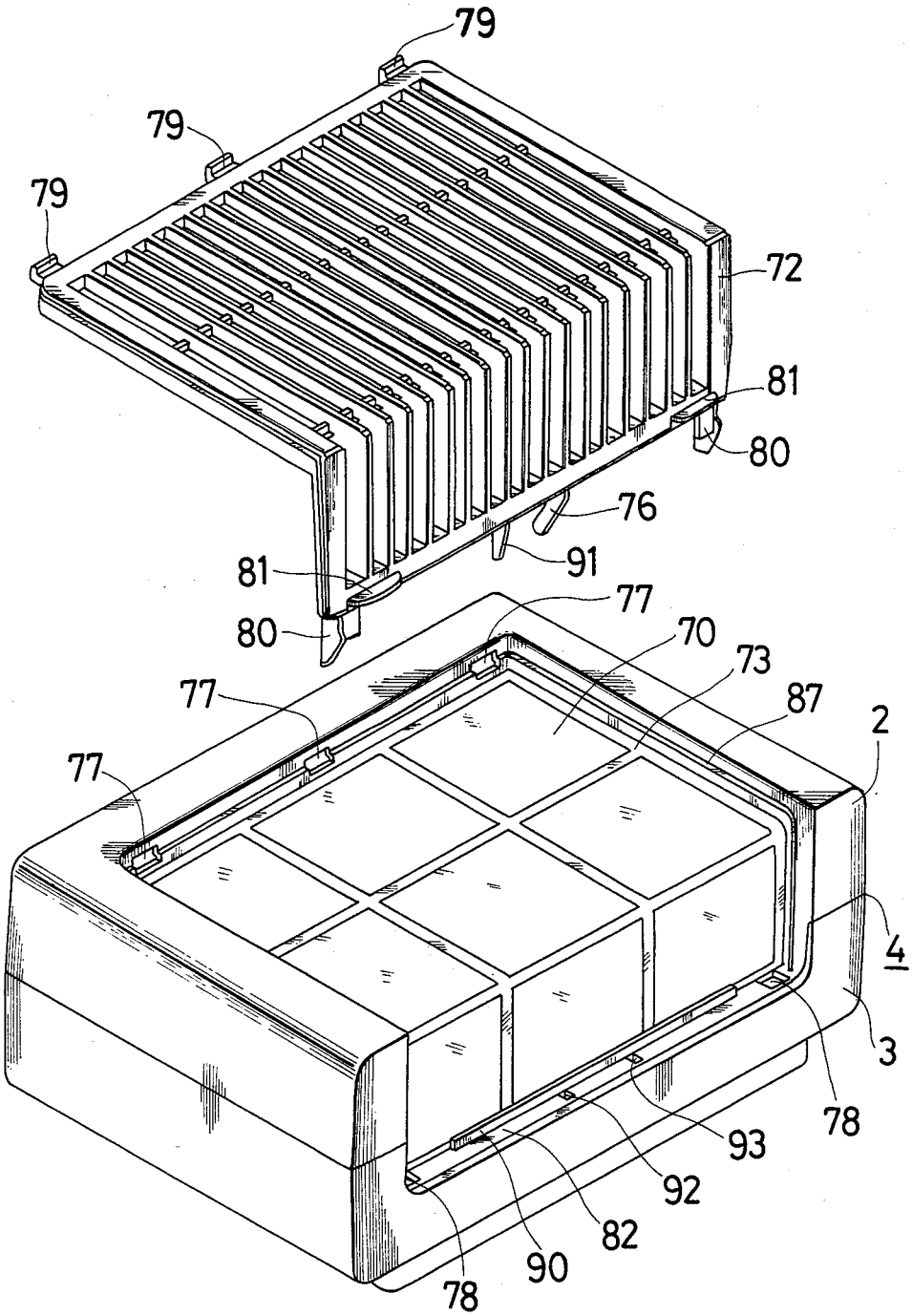
FIG. 3 is a perspective view with an intake grille removed.
Figure 4:
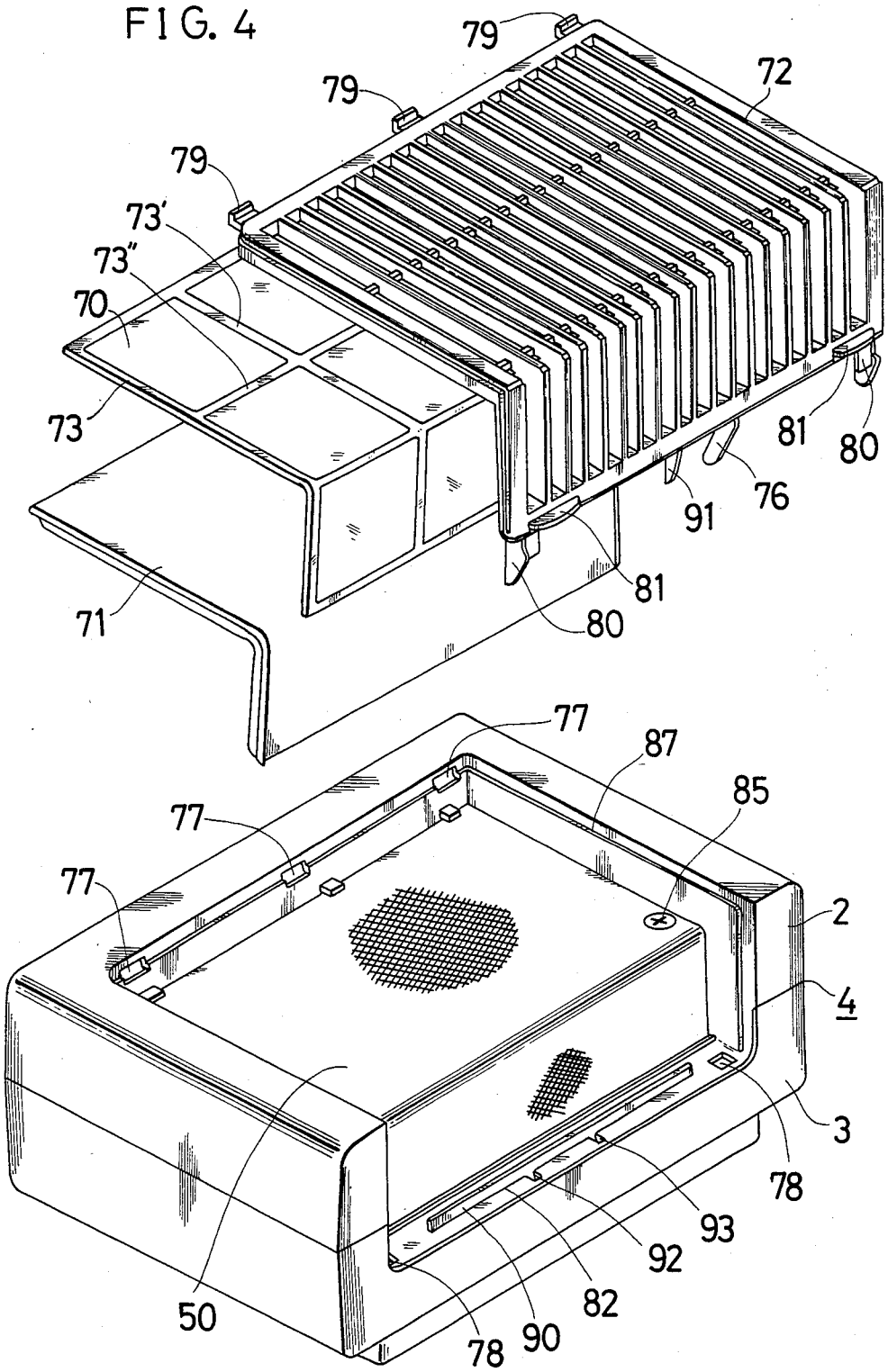
FIG. 4 is a perspective view with an electric dust-collecting device removed.
Figure 5:
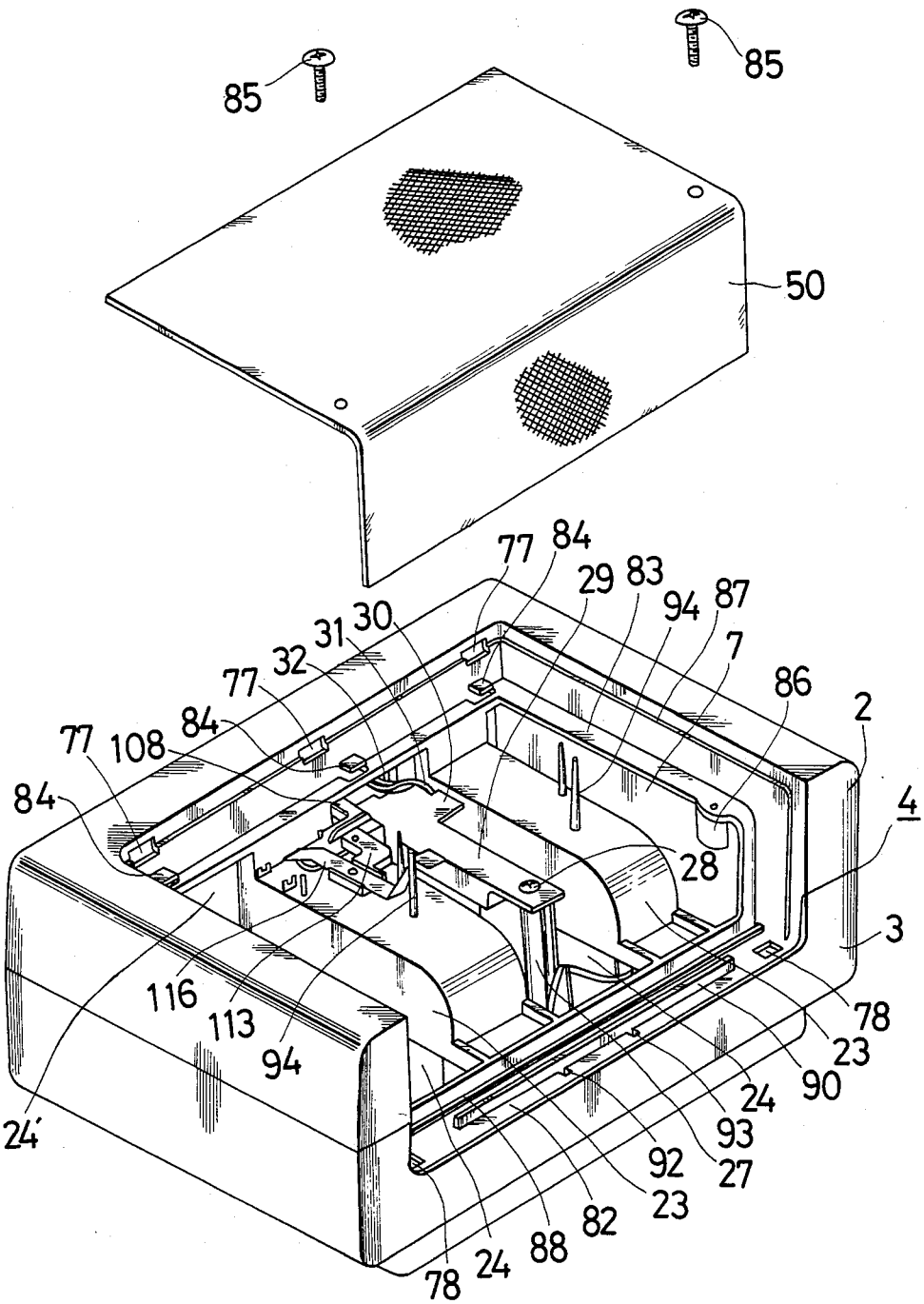
FIG. 5 is a perpective view with a second net-shaped electrode plate removed.

The blower 9 is comprised of an electric motor 21 with a rotary shaft 20 projecting from both ends thereof, fan blades 22 installed on the rotary shaft 20, and an upper casing 23 and a lower casing 24 formed into the sections of the upper case 2 and the lower case 3. In the embodiment of the invention, a sirocco fan is used as the fan blades 22, but the blades should not be restricted to it, and various other fans such as an axial fan and tangential fan may be adopted. The upper casing 23 and the lower casing 24 are formed in accordance with the function and dimensions of the fan blades 22. Since a sirocco fan is used in the embodiment , the upper casing 23 and the lower casing 24 are formed substantially in the shape of a snail with intake ports 25, 25 formed on both of the sides thereof (refer to FIG. 15). Between the lower casings 24, 24 in the lower case 3 is formed a supporting portion 26 (refer to FIG. 20) for fitting and holding a side portion of the electric motor 21. A plurality of bosses 27 project from the vicinity of the supporting portion 26, as shown in FIG. 5. An installing plate 29 is secured to each boss 27 by means of a screw 28. As the installing plate 29 is secured to the bosses 27, the installing plate 29 presses and holds the other side of the electric motor 21, and secures the supporting portion 26 as well as the electric motor 21 onto the lower case 3. Since the installing plate 29 is formed substantially in a T shape, the installing plate 29 forms an extended portion 30 extending to the inner surface of the upper case 2 and a corner section of the upper casing 23. The extended portion 30 forms an electric cord retaining part 31 by a notch and a pin, which retains an electric cord 32 which wiring is provided to the electric motor 21, the controlling part 13, and the like. Accordingly, this arrangement makes it possible to reduce the number of retaining parts for electric cords, formed in the upper case 2 and the lower case 3, thereby simplifying the construction.

Figure 26:
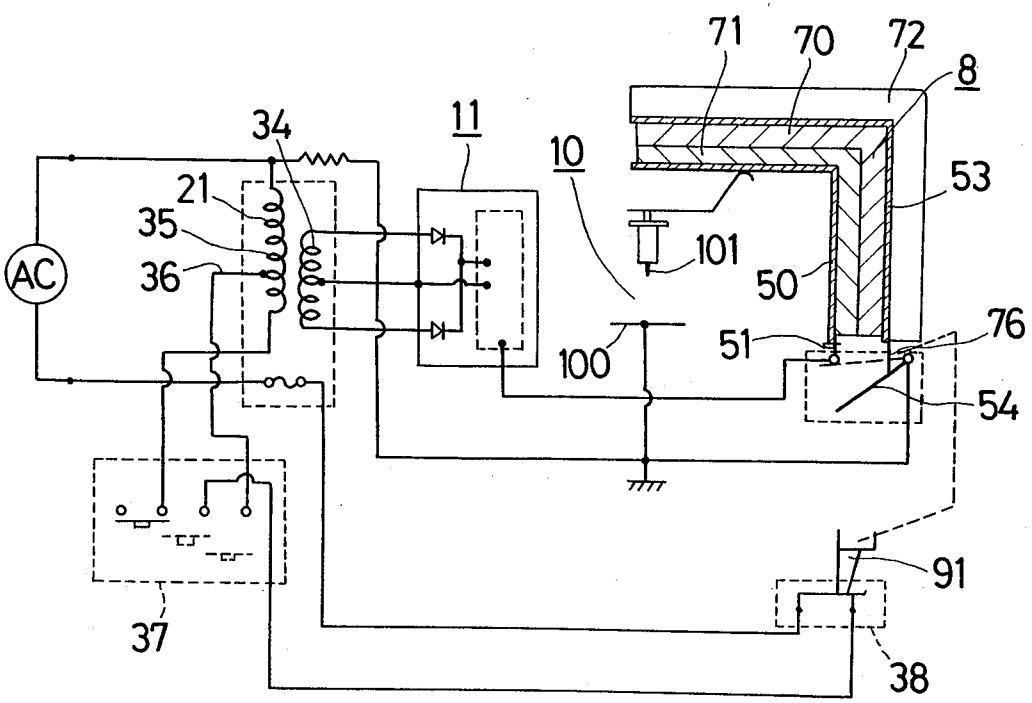
FIG. 26 is a mock circuit diagram.
Figure 27:
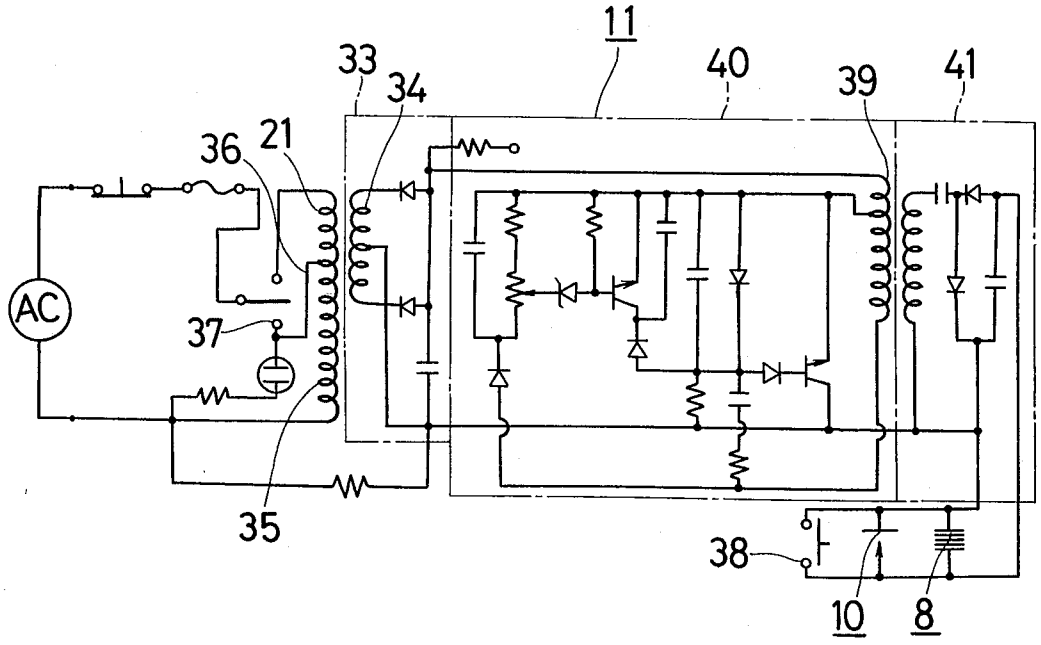
FIG. 27 is a circuit diagram.

As the electric motor 21, an induction motor, a synchronous motor, a commutator motor or the like can be used, but a shading-type induction motor is used in the embodiment of the invention. In the embodiment, in order to simplify the electric circuit of the air-purifying apparatus 1, the secondary winding 34 of the transformer of a current-feeder-and-rectifier circuit 33 to the high-voltage generating circuit 11 is, as shown in FIGS. 26 and 27, wound into the stator of the electric motor 21, and the stator winding of the electric motor 21 is also used as the primary winding of the transformer, as shown in FIGS. 26 and 27. A center governor tap 36 is pulled out from the stator winding 35, and the connection of the tap of the electric motor 21 to the switch 37 of the controlling part 13 enables the stopping, as well as low-speed and high-speed operation of the electric motor 21. A safety switch 38 is connected in series in the circuit between the electric motor 21 and the switch 37. The safety switch 38 is switched on and off by the mounting or dismounting of the electric dust-collecting device 8. In the embodiment, a switch generally called a microswitch is used as the safety switch 38.

The high-voltage generating device 11 includes the current-feeder-and-rectifier circuit 33, a stabilizing quadrature converting circuit 40 connected to the primary winding of a boosting transformer 39, and a voltage-doubling circuit 41 connected to the secondary winding of the boosting transformer 39. The switching over of the operation of the electric motor 21 generates a change in the voltage generated in the current-feeder-and-rectifier circuit 33, but since the voltage change is corrected by the stabilizing quadrature converting circuit 40, the voltage outputted by the voltage-doubling circuit 41 is stabilized. The high voltage outputted by the voltage-doubling circuit 41 is supplied to the electric dust-collecting device 8 and the ion-generating device 10.

Figure 14:
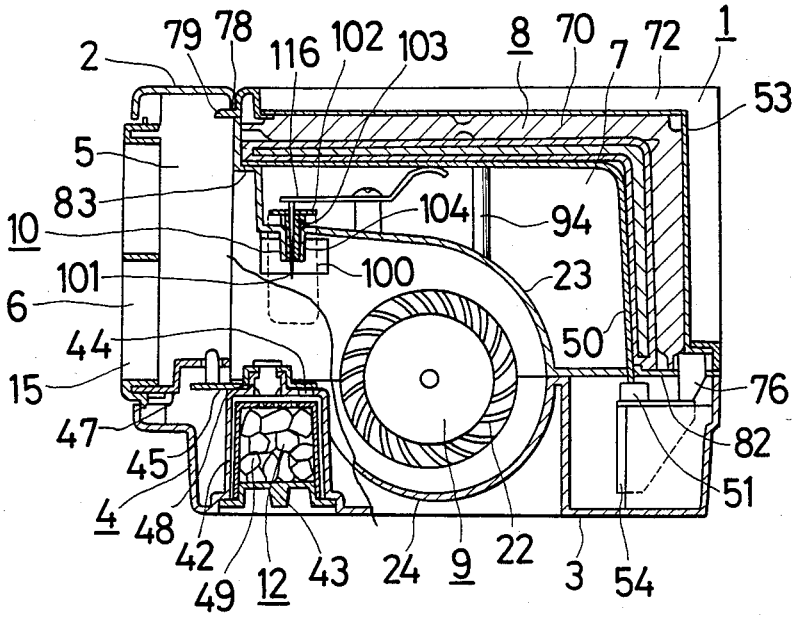
FIG. 14 is a cross-sectional view taken along the line XIV—XIV of FIG. 11.
Figure 15:
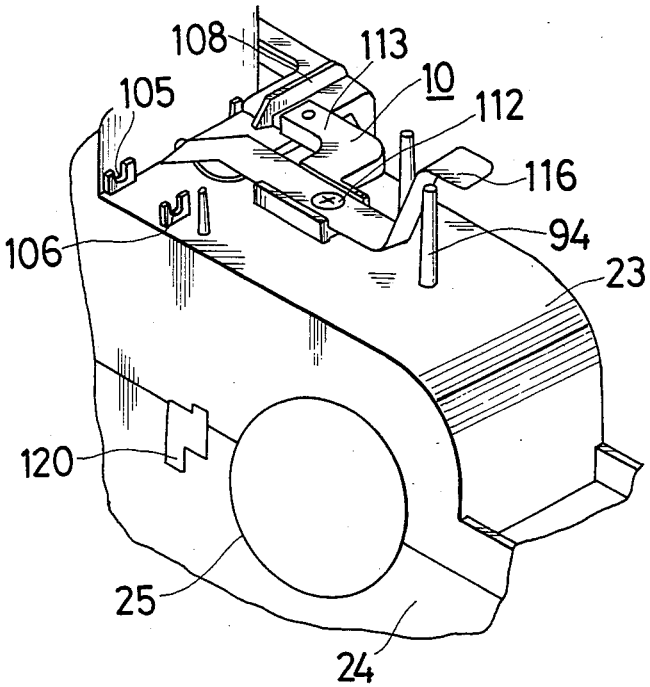
FIG. 15 is a perspective view of an ion-generating device.
Figure 17:
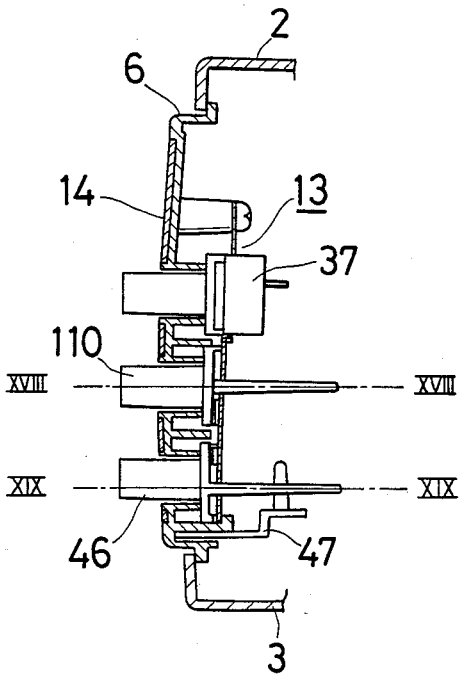
FIG. 17 is a cross-sectional view of the operating part.

As shown in FIG. 14, the fragrance-discharging device 12 comprises a container 42 formed in the lower case 3 and having an opening at the lower surface thereof, detachable cover 43 for closing the opening, a fragrance discharging port 44 formed on the container 42 on the inner-surface side of the body, and a shutter 45 for opening, closing and adjusting the fragrance discharging port 44. The shutter 45 is operated by an operating knob 46 of the controlling part 13, and the operating knob 46 and the shutter 45 are connected by means of an interlinking lever 47. In the embodiment, the shutter 45 is rotatably fixed to a pivotaly supporting part 48 formed on the upper surface of the container 42 inside the body. A fragrance material 49 is housed in the container 42 after removing the cover 43. As the fragrance material 49, a subliming type is used, and the fragrance is discharged through the fragrance-discharging port 44 and blown into a room from the air outlet grille 6 by means of the blower 9.

Figure 8:
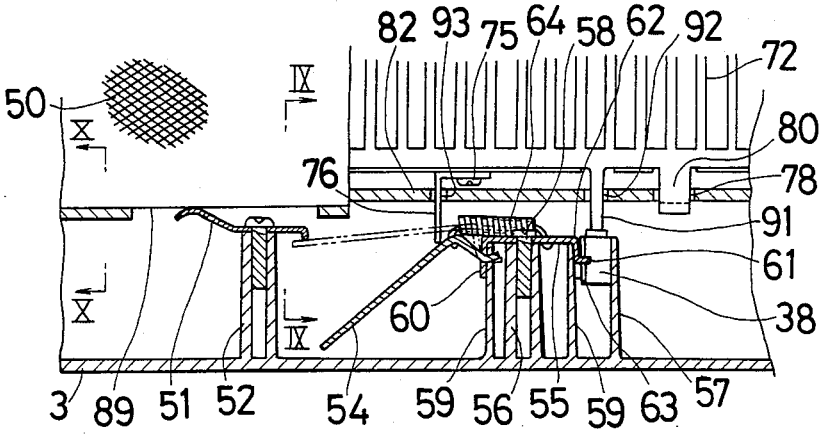
FIG. 8 is a cross-sectional view taken along the line VIII—VIII of FIG. 7.

Referring to FIG. 8, at the rear of the lower case 3 are formed the following: an installation boss 52 for a feeding bar 51 for connecting a first net-shaped electrode plate 50 of the electric dust-collecting device 8 negative electrode of the high-voltage generating device 11 (refer to FIG. 26); a fixing part 56 of an installation plate 55 which pivotally supports a short-circuit bar 54 serving as a feeding bar for connecting a second net-shaped electrode plate 53 (refer to FIG. 12) of the electric dust-collecting device 8 to the grounded positive electrode of the high-voltage generating device 11 and, at the same time, connecting the first net-shaped electrode plate 50 to the positive electrode when the electric dust collecting device 8 is removed; and a supporting part 57 for clamping the safety switch 38 between the supporting part 57 and the installation plate 55. The installation plate 55 is formed by a conductive material and formed substantially in a U shape. The fixing part 56 is formed as a boss for screwing in a fixing screw 58, and is formed between ribs 59, 59. The installation plate 55 is placed in a manner of straddling the ribs 59 and is then, together with the electric cord wired from the positive electrode of the high-voltage generating device 11, mounted on the fixing part 56 by means of the screw 58. The installation plate 55 is constituted by a pivotally supporting part 60 for pivotally supporting the short-circuit bar 54 and a retainer 62 having a projection 61 for being inserted into the installation hole of the safety switch 38. An insulating plate 63 is interposed between the safety switch 38 and the retainer 62, and the safety switch 38 is clamped by the supporting part 57 and the retainer 62. The short-circuit 54 is urged by a spring 64 in the direction of contacting the feeding bar 51.

In the embodiment, the short circuit plate 54 also serves as the feeding bar for the second net-shaped electrode plate 53, but should not be restricted as such and may be provided separately. Furthermore, the short-circuit bar 54 per se is a conductor, and short-circuit is effected through the short-circuit bar 54, but it is possible to form the short-circuit bar 54 by an insulator and to operate a short-circuit switch or a short-circuit armature by means of a short-circuit bar.

Figure 6:
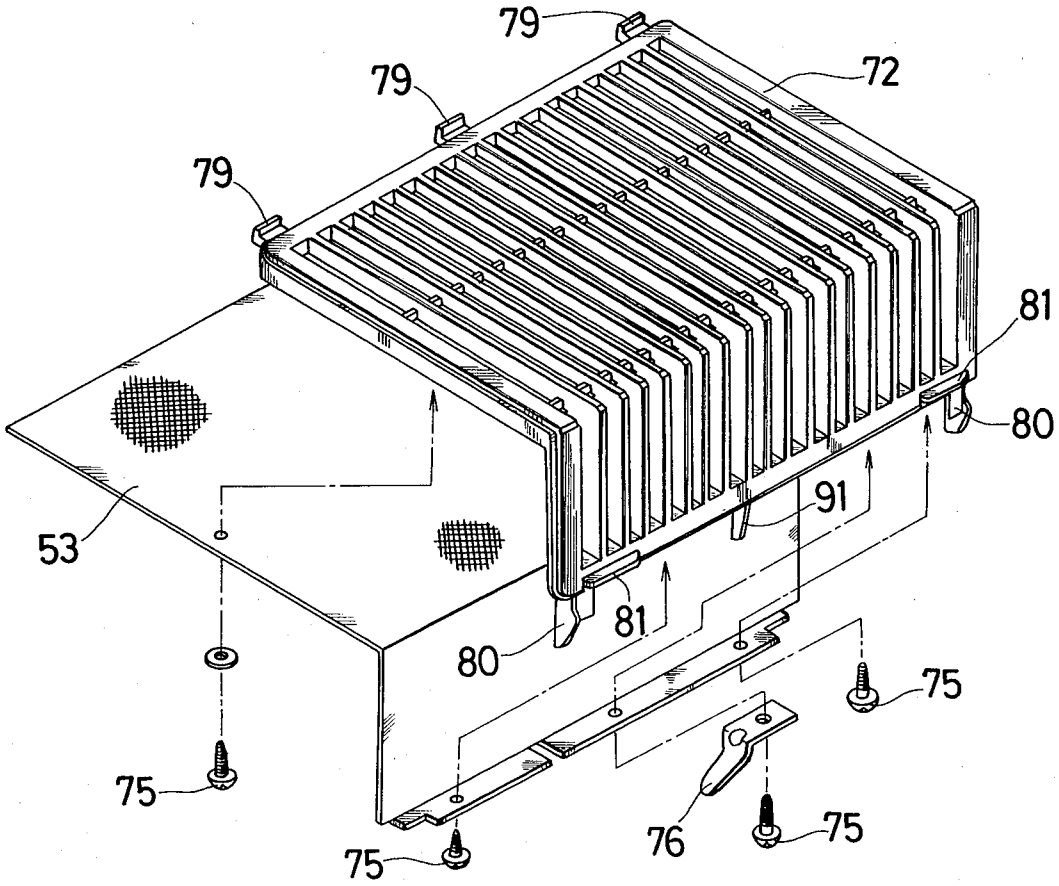
FIG. 6 is an exploded perspective view of the intake grille.

Referring to FIGS. 12 and 26, the electric dust-collecting device 8 comprises the first net-shaped electrode plate 50, the second net-shaped electrode plate 53, a dielectric material-made air-permeable filter 70 clamped between both electrode plates 50 and 53, a deodorant filter 71 constituted by activated charcoal or the like, and a grate-shaped intake grille 72. The first net-shaped electrode plate 50, the second net-shaped electrode plate 53, and the intake grille 72 are formed substantially in an L shape. The air-permeable filter 70 and the deodorant filter 71 are flexible and bend substantially in an L shape as they are clamped. The air-permeable filter 70 suffices if it is formed by a dielectric material, and may use, in concrete terms, fibers of such a synthetic resin as polyester or nylon, nonflammable fibers such as glass fibers using asbestos or the like, and fibers with such an inorganic dielectric material as magnesium fluoride, zinc sulfide, or the like adhered thereto. The air-permeable filter 70 is formed by fibers, and its peripheral portion 73 is secured to prevent fraying at the time when it is cleaned by a washing machine or the like (refer to FIG. 4). There are various securing methods, such as the one by means of high-frequency heating, softening and compression, and the one using a clamping body made of a dielectric material. In the embodiment, vertically and horizontally securing lines 73' and 73'' are formed in a checkered pattern to prevent the inclination of the fibers to one side of the air-permeable filter 70 (refer to FIG. 4). The deodorant filter 71 is formed by making a material having a deodorant effect, e.g., activated charcoal, into a sheet shape. In the embodiment, the deodorant filter 71 is formed by applying an active material to expanded polyurethane to make a sheet, and then wrapping the sheet in a nonconductive air-permeable material. An engaging retainer 74 for retaining one end of the second net-shaped electrode plate 53 is formed on the inner surface of the front side and on the upper side of the intake grille 72. Appropriate places of the peripheral portion of the second net-shaped electrode plate 53 are secured to the intake grille 72 by means of a screw 75, as shown in FIG. 6. At the lower end portion of the intake grille 72, a pressing projection 91 for operating the safety switch 38 by pressing the same is formed integrally therewith. At the same time, a conductive material-made operating projection 76 for pressing the short-circuit bar 54 suspended and secured by the screw 75 securing the second net-shaped electrode plate 53 is formed (refer to FIGS. 7, 8 and 26). At the upper-surface-side front-end portion and the lower-end portion of the intake grille 72, engaging parts 79 and 80 (refer to FIG. 4) for engaging retainers 77 and 78 formed onto the body 4 (refer to FIG. 5) are formed. A finger-engaging part 81 is formed on the lower-end rear surface adjacent to the engaging part 80 formed at the lower end portion of the intake grille 72.

Figure 7:
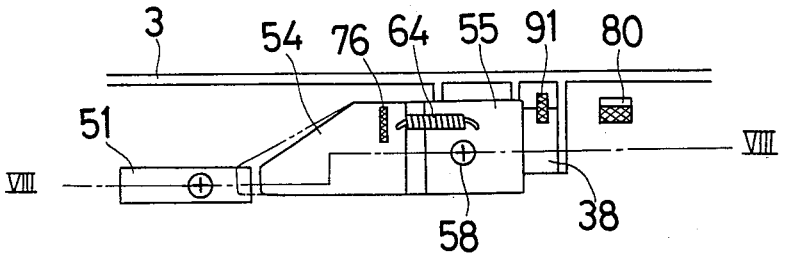
FIG. 7 is a plan view of a short-circuit bar and a safety switch portion.
Figure 9:
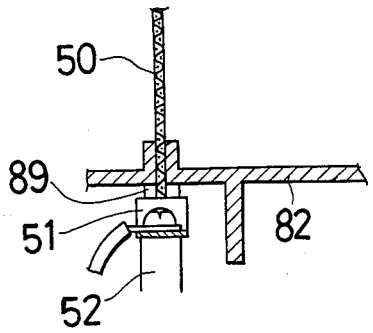
FIG. 9 is a cross-sectional view taken along the line IX—IX of FIG. 8.
Figure 10:
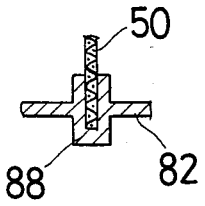
FIG. 10 is a cross-sectional view taken along the line X—X of FIG. 8.

In the upper case 2 is formed a mounting portion 82, into which the lower end of the electric dust-collecting device for covering the safety switch 38, the short-circuit bar 54 and the feeding bar 51 are brought into contact, as shown in FIGS. 7 and 8, on the inner surface of the suction port 7 where the electric dust-collecting device 8 in the upper case 2 is mounted, the following are formed, as shown in FIG. 5: a receiving part 83 for mounting and supporting the peripheral edge of the first net-shaped electrode plate 50; an engaging retainer 84 for retaining the front edge portion of the first net-shaped electrode plate 50; a boss 86 for screwing in a screw 85 for securing the vicinity of the bend of the first net-shaped electrode plate 50; a step portion 87 for mounting and supporting the peripheral portion of the intake grill 72; and the engaging retainer 77. On the mounting portion 82 are formed the following: a groove 88 into which the lower end of the first net-shaped electrode plate 50 is fitted; an insertion portion 89 where the feeding bar 51 formed in the groove 88, as shown in FIG. 8, is exposed; a supporting portion 90 for preventing the lower ends of both the air-permeable filter 70 in FIG. 3 and the deodorant filter 71 from moving upward; the engaging retainer 78; an insertion portion 92 into which the pressing projection 91 is inserted; and an insertion portion 93 into which the operating projection 76 is inserted. As shown in FIG. 8, the insertion portion 92 is formed opposing the safety switch 38, and the insertion portion 93 opposing the short-circuit bar 54. As shown in FIGS. 9 and 10, the first net-shaped electrode plate 50, when inserted into the groove 88, comes into contact with the feeding bar 51 exposed at the insertion portion 89, is connected to the negative electrode of the high-voltage generating device 11 to be charged negatively. A bending-preventing projection 94 (refer to FIG. 5) coming into contact with the intermediate portion of the first net-shaped electrode plate 50 is formed on top of the upper casing 23 in the upper case 2. By removing the intake grille 72, the safety switch 38 is turned off, and the operation of the air-purifying apparatus 1 is stopped. At the same time, the short-circuiting bar 54 is brought into contact with the feeding bar 51, discharging the potential built up in the first net-shaped electrode plate 50. Accordingly, an accident of electrification does not occur even if the intake grille 72 is removed to clean air-permeable filter 70 and the deodorant filter 71 without stopping the air-purifying apparatus 1. The contacting of the short-circuiting bar 54 to the feeding bar 51 is effected after the safety switch 38 is turned off.

Figure 16:
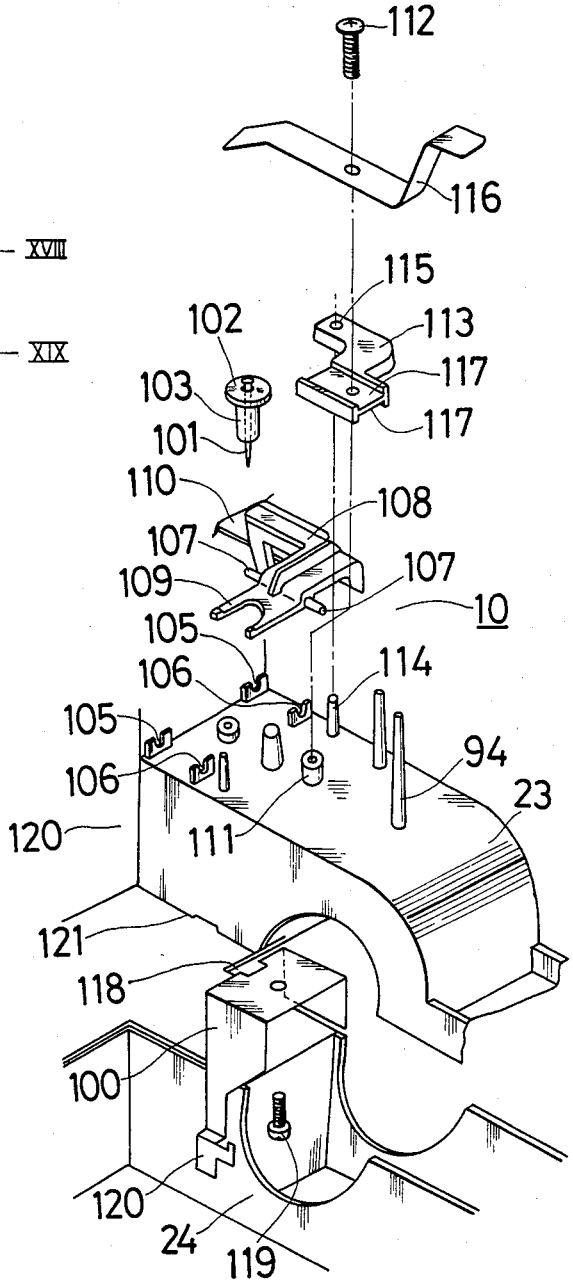
FIG. 16 is an exploded perspective view.
Figure 18:
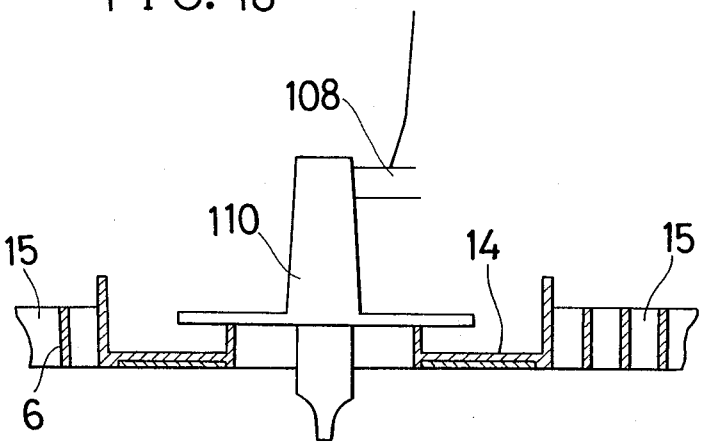
FIG. 18 is a cross-sectional view taken along the line XVIII—XVIII of FIG. 17.
Figure 19:
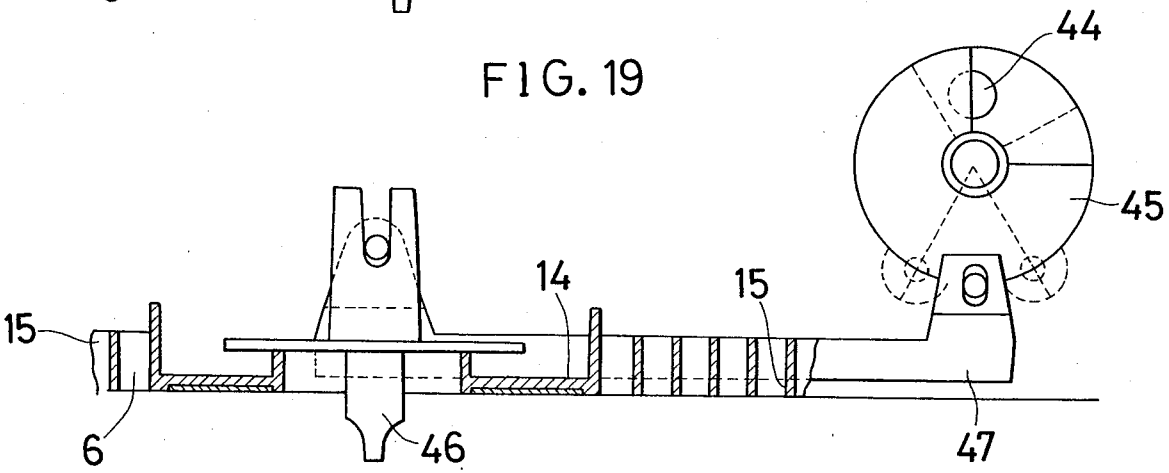
FIG. 19 is a cross-sectional view taken along the line XIX—XIX of FIG. 17.
Figure 20:
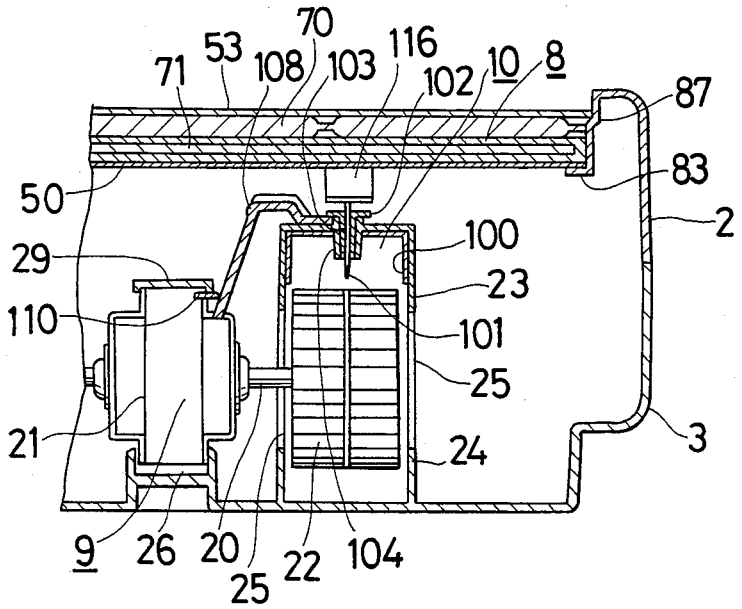
FIGS. 20 and 21 are cross-sectional views of the ion generating device.
Figure 21:
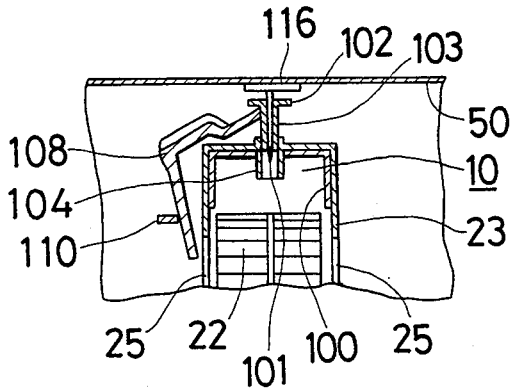
Figure 22:
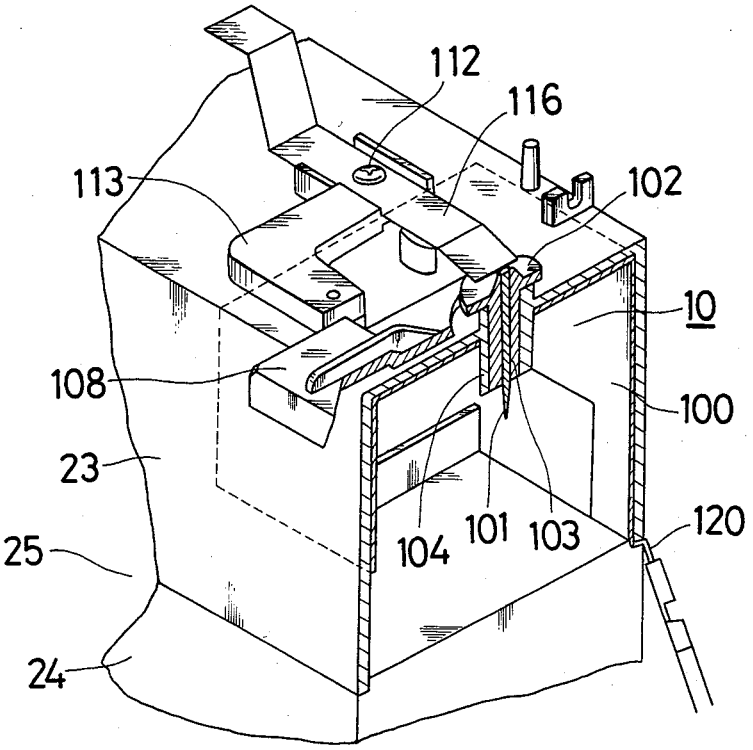
FIG. 22 is a sectional perspective view of the ion generating device.
Figure 23:
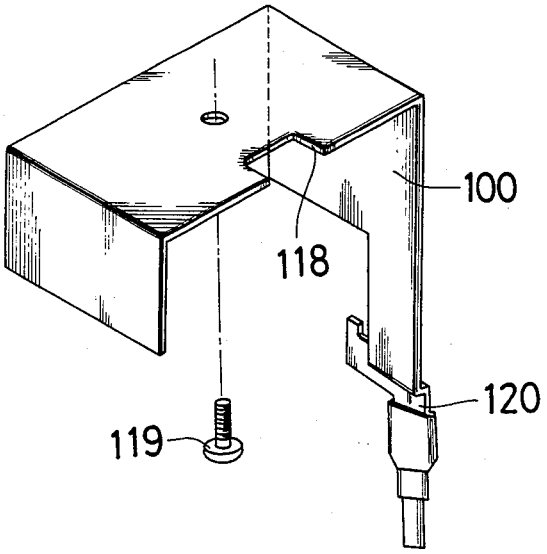
FIG. 23 is a perspective view of an opposing ionizing electrode.

Referring to FIGS. 16, 22 and 23, the ion-generating device 10 is constituted by a substantially U-shaped ionization opposing electrode 100, a needle-shaped ionization electrode 101, and a means of hampering the concentration of the electric field of the needle-shaped ionization electrode 101. In the embodiment, hampering of the concentration of the electric field, is carried out by bringing ionization electrode 101 in and out of the upper casing 23. The needle-shaped ionization electrode 101 is embedded in a columnar body 103 forming a collar 102 at the end thereof, and the columnar body 103 is inserted into a cylindrical hole 104 formed on the upper casing 23 for installing the columnar body 103 (refer to FIG. 20). The operation of entrance and withdrawal of the columnar body 103 is effected by an operating body 108 where pivots 107, 107, supported pivotally by a bearing hole 105 and a bearing groove 106 both formed on one upper surface side of the upper casing 23, project therefrom. The operating body 108 clamps the columnar body 103 in a manner of engaging a bifurcating portion 109 formed at one end thereof with the collar 102, and rotatably operates by pressing the other end of the operating body 108 by means of a knob 110 of the operating part 13. The bearing groove 106 is covered and blocked by an installation member 113 secured to a boss 111 projecting from the casing 23 by means of a screw 112. A fitting hole 115, into which a locating pin 114 projecting from the upper casing 23, is formed at the installation member 113. At the installation member 113, a locating portion 117 of a terminal bar 116 for feeding electricity to the needle-shaped ionization electrode 101 is formed. The terminal bar 116 is secured to the upper casing 23 together with the the installation member 113 by means of the screw 112. The terminal bar 116, being in the secured state, contacts and pushes downward the needle-shaped ionization electrode 101 by means of its resilient force. The returning force of the operating body 108 is obtained by the terminal bar 116. One end of the terminal bar 116 rises upward, projects upward above the bending-preventing projection 94, and presses the first net-shaped electrode plate 50 by means of its resilient force. The bearing hole 105 and the bearing groove 106 are also formed on the other upper surface side of the upper casing 23, in such a way that the upper case 2 is also commonly used in a second embodiment, which will be described later. The ionization opposing electrode 100 is fitted on the inner surface of the upper casing 23, forms an escape portion 118 for receiving the cylindrical hole portion 104, and is, at the same time, secured by a screw 119. A tongue-shaped feeding portion 120 is formed at one lower end of the ionization opposing electrode 100. The feeding portion 120 projects outside the casing 23 through a knotched insertion portion 121 provided at the lower edge of the upper casing 23. The feeding portion 120 is connected to the positive electrode (group) of the high-voltage generating device 11.

Figure 24:
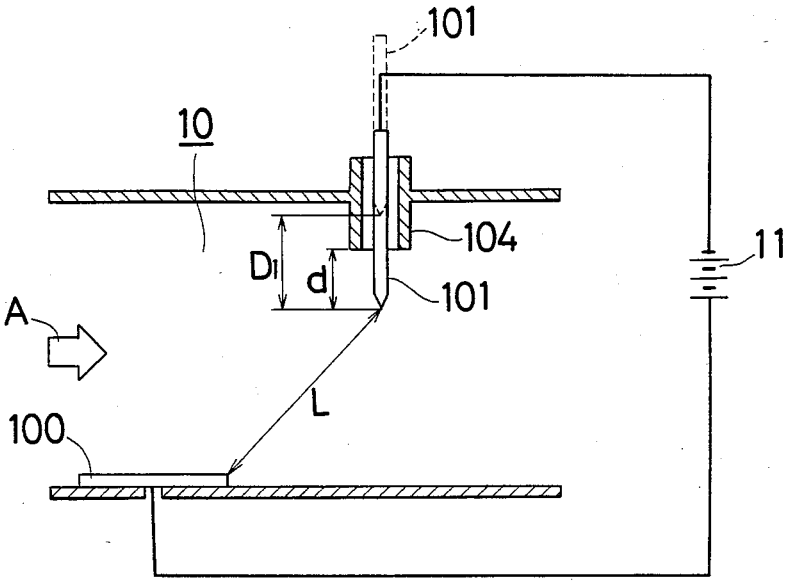
FIG. 24 is an explanatory diagram illustrating the basic principles of the ion generating device.
Figure 25:
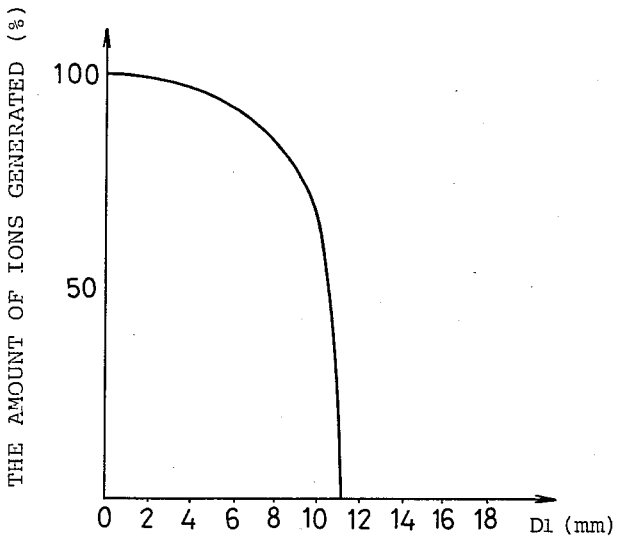
FIG. 25 is a chart of characteristics of the ion generating device shown in FIG. 24.

Referring to FIGS. 24 and 25, description of the operating principle of the ion-generating device 10 will be made hereinunder.

When a high voltage is applied to the needle-shaped ionization electrode 101 and the ionization opposing electrode 100, a corona discharge occurs between the two electrodes 101 and 100, and negative ions are produced at that juncture. A corona discharge occurs on the basis of the function between the radius of curvature of the end of the needle-shaped ionization electrode 101 on the one hand, and the length of a gap between the two electrodes 101 and 100 on the other. When a high voltage is applied, an electric field concentrates at the tip of the needle-shaped ionization electrode 101, and ionization occurs in that vicinity. As the needle-shaped ionization electrode 101 is negative, ions are discharged from the ionization region and heads toward the ionization opposing electrode 100. At that juncture, electrons are adhered to gaseous particles and form negative ions. The negative ions are blown out together with an air flow (A). Since the needle-shaped ionization electrode 101 is adapted to move freely into and out of the cylindrical hole 104, it is possible to control and stop the amount of ions generated, without turning off the high-voltage generating device. The needle-shaped ionization electrode 101 in a discharging state is pulled into the cylindrical hole portion 104. At this juncture, the inner surface of the cylindrical hole portion 104 is positively charged by dielectric polarization, but is neutralized by electrons generated in the vicinity of the needle-shaped ionization electrode 101, thereby negatively electrifying the inner surface of the cylindrical hole portion 104. With the negative electrification of the inner surface of the cylindrical hole portion 104, a change occurs to the function for causing a corona discharge to occur, i.e., between the radius of curvature and a gap length, the concentration of the electric field is hampered, and corona discharge weakens and stops. FIG. 25 is a graph showing the relationship between the amount of ions generated and the amount of pulling out from the position of maximum insertion (the distance $D_1$ of movement of the needle-shaped ionization electrode 101) under conditions that the high voltage applied is 6.3 kV, the gap length between the two electrodes 101 and 100 is 32 mm, and the distance from the lower end of the cylindrical hole portion 104 to the position d of the maximum insertion is 8 mm. As can be understood from the graph, by varying the distance of movement of the needle-shaped ionization electrode 101, i.e., the distance between the two electrodes 101 and 100, it is possible to adjust the amount of ions contained in the air sent from the air outlet 5.

By mechanically effecting the stopping and moving of the ion-generating device 10 and the adjustment of the amount of ions, it is possible to use in common the electric dust-collecting device 8 and the high-voltage-generating device 11.

The electric dust-collecting device 8 is detachably formed in a manner of blocking the intake port 7 of the body 4, and the body 4 is opened wide by removing the electric dust-collecting device 8. Since the electric dust-collecting device 8 has the same function as that of a bottom plate or a rear plate installed on a conventional electric appliance, this arrangement facilitates the maintenance and inspection of the high-voltage generating device 11, the ventilation device 9, and the like installed inside the body 4. Furthermore, since the the electric dust-collecting device 8 also serves as the side wall of the body 4, it is possible to readily install and remove the electric dust-collecting device 8. In addition, the state of dust collected can be confirmed visually, offering convenience in using the air-purifying apparatus 1, and, at the same time, the air-purifying apparatus 1 can be formed compactly. To cite an example for your reference, the external dimensions of the air-purifying apparatus 1 may be 300 (width) $\times$200 (depth) $\times$146 (height) mm, and the air-purifying apparatus 1 can be suitably used in a 3$\times$3 m room.

In FIG. 5, a partition plate 24' is formed in the portion opposing the ventilation portion 15 of the air outlet grille 6, except for the air outlet portion of the upper and lower casings 23, 24 of the body 4. The partition plate 24' opposing the right-hand ventilation portion 15 of the air outlet grille 6 is detachably formed in such a way that the body 2 can be used in common in the second embodiment, which will be described later.

Now, description will be made of the second embodiment with reference to FIGS. 28 to 34.

According to the second embodiment, the operating portion is formed on the right-hand side, the function of the embodiment being the same as that of the first embodiment. Each part is indicated by the same appellations and reference numerals, and description is omitted. With respect to the second embodiment, description will be made of only such portions whose structure differs from that of the first embodiment.

The installation part 14 where the operating part 13 is installed is formed on the right-hand portion of the air outlet grille 6. The body 4 is used in common as that in the first embodiment, the partition plate 24' is removed, and a partition plate is provided at the portion opposing the operating part. Referring to FIGS. 32 and 33, the operating body 108 for operating the needle-shaped ionization electrode 101 is formed in such a shape as it has plane symmetry via-a-vis the operating body of the first embodiment, and is pivotally supported by the bearing hole 105 and the bearing groove 106 formed on the other side of the upper surface of the upper casing 23. The shutter 45 of the fragrance-discharging device 12 is directly operated by the operating knob 46.

Description will now be made of a third embodiment with reference to FIGS. 35 to 38.

According to the third embodiment, the structure of the ion-generating device is changed from that of the other embodiments. Incidentally, the same structural portions as those of the other embodiments are indicated by the same appellations and reference numerals, and, at the same time, the drawings are omitted and only essential parts are described. The needle-shaped ionization electrode 101 is inserted into the cylindrical hole portion 104 of the upper casing 23. The ionization opposing electrode 100 opposing the needle-shaped ionization electrode 101 is secured to the lower casing 24 by means of a screw 121. An ion-generation-regulating member 122 is located between the needle-shaped ionization electrode 101 and the ionization opposing electrode 100, and the regulating member 122 is caused to contact or move away from the needle-shaped ionization electrode 101 by means of the operating knob 46 of the operating part 13. The regulating member 122 is formed by a dielectric material.

The operating principle of the ion-generating device 10 will now be described with reference to FIG. 37.

The gap length between the needle-shaped ionization electorde 101 and the ionization opposing electrode 100 is set at a dimension at which a corona discharge occurs. If the regulating member 122 is brought too close to the needle-shaped ionization electrode 101, dielectric polarization occurs, the opposing side is electrified positively, and electrons from the needle-shaped ionization electrode 101 is absorbed. With the absorption of the electrons, the positive charge of the regulating member 122 is neutralized, while the regulating member 122 is electrified negatively. With the negative electrification of the regulating member 122, the movement of the electrons toward the ionization opposing electrode 100 is dispersed, while, at the same time, affecting the ionized region formed in the vicinity of the needle-shaped ionization electrode 101, which, in turn, hampers the concentration of the electric field of the needle-shaped ionization electrode 101. As a result, a corona discharge weakens and stops. FIG. 38 is a graph showing the relationship between amount of ions generated and the distance between the the needle-shaped ionization electrode 101 and the regulating member 122 (the distance $D_2$ between the needle-shaped ionization electrode 101 and the regulating member 122). under conditions that the applied voltage is 6.3 kV, the gap length between the two electrodes 101 and 100 is 32 mm, and the length d of the needle-shaped ionization electrode 101 projecting from the cylindrical hole 104 is 8 mm.

In the case of the respective embodiments mentioned above, it is possible to enlarge the dust-collecting area as compared with an air purifying machine having an electric dust-collecting device on one side thereof, since the electric dust-collecting device 8 is formed substantially in an L shape, forming a wall portion extending from the upper surface to the rear surface of the body 4. In FIG. 12, for instance, when dust particles adhere to the air-permeable filter 70 and the deodorant filter 71 and these filters contain moisture, electric discharge occurs between the first net-shaped electrode plate 50 and the second net-shaped electrode plate 53. Hence, the first net-shaped electrode plate 50 is coated with resin to prevent the discharge from occurring.

The ion-generating device 10 and the fragrance-discharging device 12 that are built in the air purifying apparatus 1 are such devices that provide additional functions, and therefore are not particularly required. The ion-generating device 10, which ionizes the air to be blown off, has a function of electrifying dust floating in a room, and has the function of enhancing the dust-collecting efficiency of the electric dust-collecting device 8.

Although the present invention has been described with reference to the first, second and third embodiments, they are only some embodiments, and various modifications are possible without departing the scope and spirit of the invention if the constitutent requirements described in the claims are met.

As described above, the air-purifying apparatus relating to the present invention has advantages in that, since the intake port of the body is covered with a detachably mounted electric dust-collecting device, an extra space is not required on the intake side of the electric dust-collecting device, the overall air-purifying apparatus can be formed conpactly, the mounting and dismounting of the electric dust-collecting device can be facilitated, and the inspection and the maintenance of the body can be effected with ease.

What is claimed is:

1. An air-purifying apparatus comprising: a main body having an intake portion and an outlet portion; a blowing means disposed in said main body and adapted to induce the ambient air through said intake portion and to forward the air to said outlet portion; and a high-voltage generating means mounted in said main body; wherein said intake portion includes a intake grille, first and second net-shaped electrode plates disposed along the inner side of said intake grille and opposing each other with a large potential difference developed therebetween by said high-voltage generating means, said first net-shaped electrode plate being remoter from said intake grille than said second net-shaped electrode plate, and an air-permeable filter made of a dielectric material disposed between said first and second electrode plates, and wherein at least said intake grille and said second net-shaped electrode plate being detachable from said main body.

2. An air-purifying apparatus according to claim 1, wherein said second net-shaped electrode plate is fixed to the inner side of said intake grille which, together with said second net-shaped electrode plate, is detachably fixed to said main body.

3. An air-purifying apparatus according to claim 2, wherein said intake grille is detachably fixed to said main body solely by its resiliency.

4. An air-purifying apparatus according to claim 1, wherein said air-permeable filter made of dielectric material has a deodorant filter containing activated charcoal and superposed thereto.

5. An air-purifying apparatus according to claim 1, wherein said main body has a substantially rectangular parallel-piped shape and said intake portion is formed over two adjacent side surfaces thereof in a substantially L-shaped form when viewed in section.

6. An air-purifying apparatus according to claim 1, wherein an ion-generating means capable of adjusting the ion-generating rate is disposed in the vicinity of said outlet portion.

7. An air-purifying apparatus according to claim 6, wherein said ion-generating means includes an ionization opposing electrode and a needle-shaped ionization electrode arranged for free adjustment of distance therebetween.

8. An air-purifying apparatus according to claim 7, wherein said needle-shaped ionization electrode is adapted to be supplied with electric power from a resilient terminal plate which contacts said first net-shaped electrode plate.

9. An air-purifying apparatus according to claim 1, wherein said second net-shaped electrode plate constitutes a grounded electrode, while said first net-shaped electrode plate constitutes an opposing electrode which opposes said grounded electrode.

10. An air-purifying apparatus according to claim 9, wherein said first net-shaped electrode includes a short-circuit bar which is adapted to contact said grounded electrode when said intake grille is detached from said main body, and a safety switch which can prevent the supply of the high voltage from said high-voltage generating means in advance to the contact of said short-circuit bar with said grounded electrode.

11. An air-purifying apparatus according to claim 1, futher comprising a fragrance-discharging means in the vicinity of said outlet portion in said main body.

* * * * *